US010198920B1

(12) United States Patent
Yoneoka et al.

(10) Patent No.: US 10,198,920 B1
(45) Date of Patent: Feb. 5, 2019

(54) WEARABLE ELECTRONIC DEVICE INCLUDING AUDIO OUTPUT TRANSDUCER AND HAPTIC ACTUATOR DRIVING AND RELATED METHODS

(71) Applicant: Apple Inc., Cupertino, CA (US)

(72) Inventors: Shingo Yoneoka, Sunnyvale, CA (US); Alex M. Lee, Sunnyvale, CA (US); Jia Tao, Santa Clara, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 15/718,379

(22) Filed: Sep. 28, 2017

(51) Int. Cl.
*G08B 6/00* (2006.01)
*H04R 3/00* (2006.01)
*H04R 1/02* (2006.01)

(52) U.S. Cl.
CPC ..... *G08B 6/00* (2013.01); *H04R 1/028* (2013.01); *H04R 3/00* (2013.01); *H04R 2420/07* (2013.01)

(58) Field of Classification Search
CPC ..... G06F 3/00; G06F 3/016; G06F 3/0414; G06F 3/165; G06F 17/30761; H04R 1/00; H04R 1/009; H04R 2420/07; H04R 2460/00; H01L 41/00
USPC ..... 700/94; 381/58, 23; 345/173, 156, 417
See application file for complete search history.

(56) References Cited

U.S. PATENT DOCUMENTS

| | | | | |
|---|---|---|---|---|
| 8,169,402 | B2 | 5/2012 | Shahoian et al. | |
| 2012/0206248 | A1 | 8/2012 | Biggs | |
| 2014/0197936 | A1 | 7/2014 | Biggs et al. | |
| 2015/0109223 | A1 | 4/2015 | Kessler et al. | |
| 2015/0116205 | A1 | 4/2015 | Westerman et al. | |
| 2015/0130730 | A1 | 5/2015 | Harley et al. | |
| 2015/0195664 | A1* | 7/2015 | Lin | H04R 29/00 381/58 |
| 2016/0027338 | A1* | 1/2016 | Ebeling | G09B 21/009 340/4.12 |
| 2016/0378071 | A1* | 12/2016 | Rothkopf | G06F 1/1643 368/10 |
| 2017/0135896 | A1* | 5/2017 | Snow | A61H 23/008 |
| 2017/0150273 | A1* | 5/2017 | Afshar | H04R 9/06 |

FOREIGN PATENT DOCUMENTS

| | | | |
|---|---|---|---|
| WO | 2013169299 | A1 | 11/2013 |
| WO | 2013169303 | A1 | 11/2013 |
| WO | 2013169305 | A1 | 11/2013 |
| WO | 2013170099 | A1 | 11/2013 |
| WO | 2013188307 | A2 | 12/2013 |
| WO | 2014018111 | A1 | 1/2014 |
| WO | 2015020663 | A1 | 2/2015 |

OTHER PUBLICATIONS

Product Specification Sheet: GEEPLUS, VIBRO1 Vibration Actuator, 2 pages, www.geeplus.biz, downloaded on Jul. 15, 2015.

* cited by examiner

*Primary Examiner* — Melur Ramakrishnaiah
(74) *Attorney, Agent, or Firm* — Allen, Dyer, Doppelt + Gilchrist, P.A.

(57) ABSTRACT

A wearable electronic device may include a wearable band and audio output transducers carried by the wearable band. The wearable electronic device may also include respective haptic actuators carried by the wearable band and adjacent respective ones of the audio output transducers. A drive circuit may be configured to concurrently drive the audio output transducers with respective first drive signals, and drive the haptic actuators with respective second drive signals different than the first drive signals.

19 Claims, 11 Drawing Sheets

WEARABLE ELECTRONIC DEVICE INCLUDING AUDIO OUTPUT TRANSDUCER AND HAPTIC ACTUATOR DRIVING AND RELATED METHODS

TECHNICAL FIELD

The present disclosure relates to the field of electronics, and, more particularly, to the field of haptics.

BACKGROUND

Haptic technology is becoming a more popular way of conveying information to a user. Haptic technology, which may simply be referred to as haptics, is a tactile feedback based technology that stimulates a user's sense of touch by imparting relative amounts of force to the user.

A haptic device or haptic actuator is an example of a device that provides the tactile feedback to the user. In particular, the haptic device or actuator may apply relative amounts of force to a user through actuation of a mass that is part of the haptic device. Through various forms of tactile feedback, for example, generated relatively long and short bursts of force or vibrations, information may be conveyed to the user.

SUMMARY

A wearable electronic device may include a wearable band and a plurality of audio output transducers carried by the wearable band. The wearable electronic device may also include a plurality of respective haptic actuators carried by the wearable band and adjacent respective ones of the plurality of audio output transducers and a drive circuit configured to concurrently drive the plurality of audio output transducers with respective first drive signals, and drive the plurality of haptic actuators with respective second drive signals different than the first drive signals.

The first and second drive signals may be based upon a same audio input signal, for example. The first drive signals may be based upon an audio input signal, and wherein the second drive signals are synthesized based upon the audio input signal. The first and second drive signals may be phase delayed, for example.

The wearable band may include a headband. The wearable band may include a wristband, for example.

The drive circuit may include a plurality of audio inputs, a plurality of haptic actuator outputs coupled to respective haptic actuators, and a plurality of respective filters coupled between respective ones of audio inputs and haptic actuator outputs. The drive circuit may include a plurality of respective haptic actuator gain stages coupled between respective ones of audio inputs and haptic actuator outputs. The drive circuit may include a plurality of audio outputs coupled to respective audio output transducers, and a plurality of respective audio gain stages coupled between respective ones of audio inputs and audio outputs, for example.

The wearable electronic device may further include a plurality of circuit substrates carried by the wearable band, and each circuit substrate may carry a respective audio output transducer and haptic actuator pair, for example.

A method aspect is directed to a method of providing a haptic effect to a user of a wearable electronic device that includes a wearable band, a plurality of audio output transducers carried by the wearable band, and a plurality of respective haptic actuators carried by the wearable band and adjacent respective ones of the plurality of audio output transducers. The method may include concurrently driving the plurality of audio output transducers with respective first drive signals, and driving the plurality of haptic actuators with respective second drive signals different than the first drive signals.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notation and numbers in increments of 100 are used to indicate similar elements in alternative embodiments.

Figure 1:
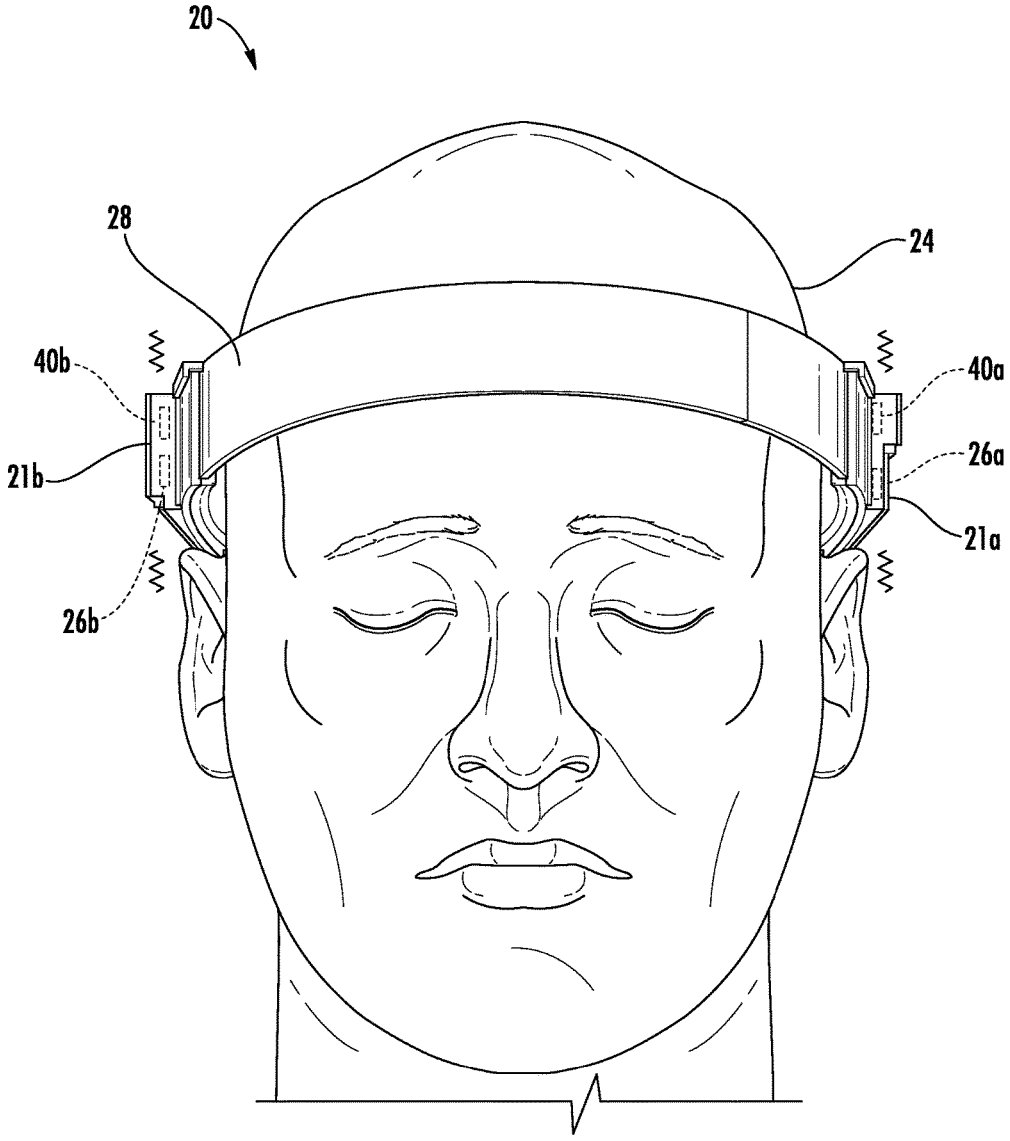
FIG. 1 is a perspective view of a wearable electronic device worn by a user according to an embodiment.
Figure 2:
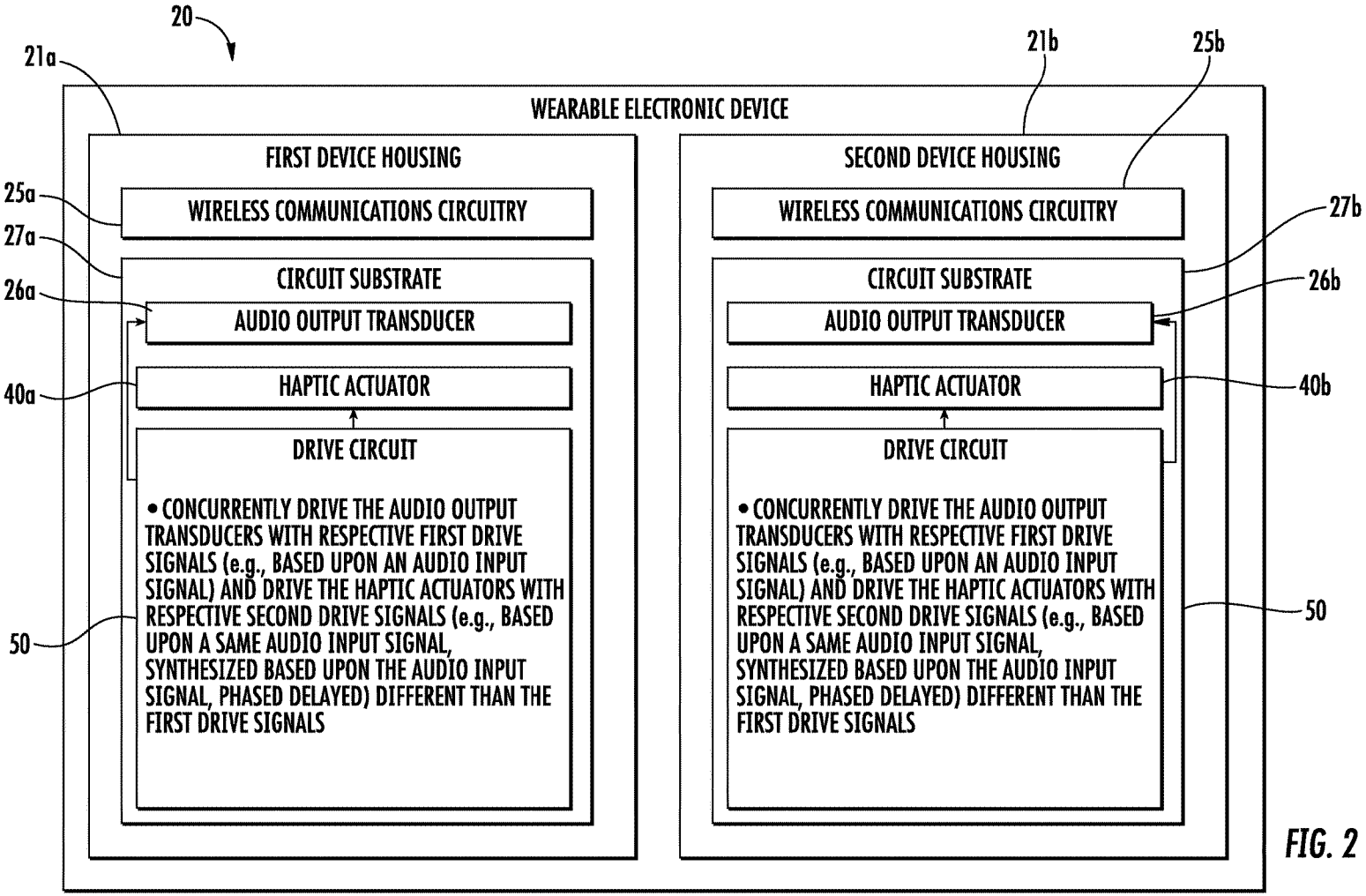
FIG. 2 is a schematic block diagram of the wearable electronic device of FIG. 1.
Figure 3:
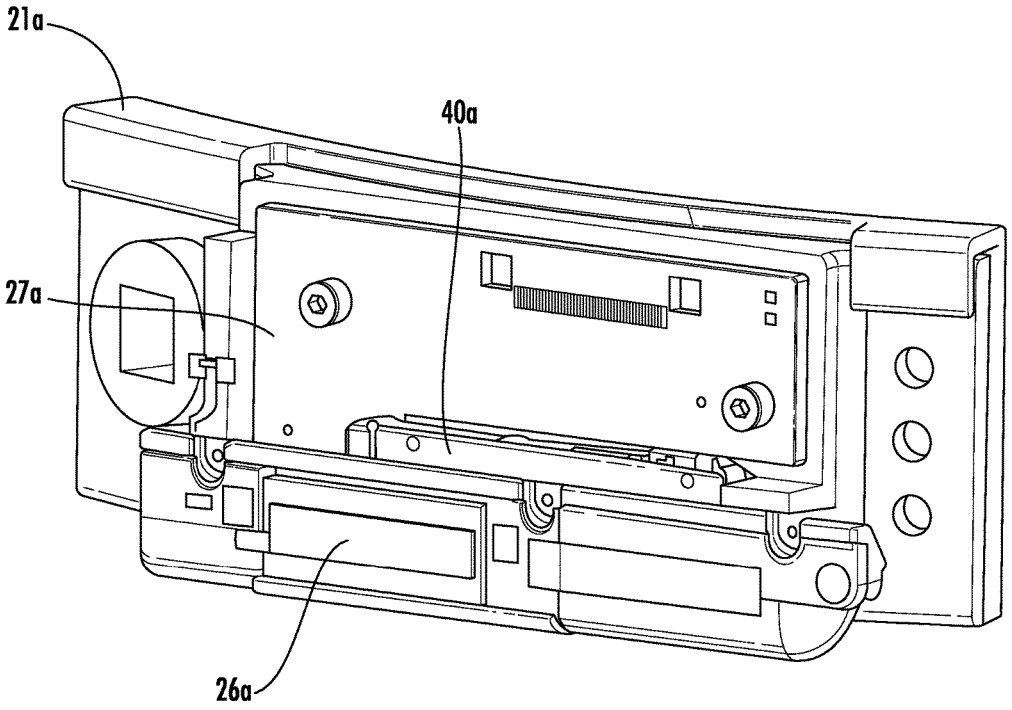
FIG. 3 is a perspective view of a portion of the wearable electronic device of FIG. 1.

Referring initially to FIGS. 1-3, a wearable electronic device 20 includes a wearable band 28 or strap for securing the electronic device to a user 24. The wearable electronic device 20 is illustratively in the form of a headset as the wearable band 28 is in the form of a headband that includes elastic, but, as a will be described in further details below, may be another type of wearable electronic device.

The wearable electronic device 20 includes first and second device housings 21*a*, 21*b*. Respective wireless communications circuitry 25*a*, 25*b* (e.g. cellular, WLAN Bluetooth, etc.) may also be carried within each respective device housing 21*a*, 21*b*. The wireless communications circuitry 25*a*, 25*b* may perform at least one wireless communications function, for example, for voice and/or data. In some embodiments, the wearable electronic device 20 may not include wireless communications circuitry 25*a*, 25*b*.

The wearable electronic device 20 also includes audio output transducers 26*a*, 26*b* carried by the wearable band 28. More particularly, a respective audio output transducer 26*a*, 26*b* is carried within the first and second device housings 21*a*, 21*b* by a respective circuit substrate 27*a*, 27*b*. The audio output transducers 26*a*, 26*b* or speakers may define stereo speakers. For example, a first audio output transducer 26*a* may be a left channel and a second audio output transducer 26*b* may be a right channel.

Respective haptic actuators 40*a*, 40*b* are carried by the wearable band 28 and adjacent respective ones of the audio output transducers 26*a*, 26*b*. Each respective actuator 40*a*, 40*b* may be carried within the corresponding one of the first and second housings 21*a*, 21*b* by the respective circuit substrate 27*a*, 27*b*. In other words, the first housing 21*a* may carry a left channel audio output transducer 26*a* and a left channel haptic actuator 40*a*, while the second housing 21*b* may carry the right channel audio output transducer 26*b* and a right channel haptic actuator 40*b* (i.e., each respective circuit substrate carries an audio output transducer and haptic actuator pair). The haptic actuators 40*a*, 40*b* may be carried between the respective circuit substrate 27*a*, 27*b* and the respective audio output transducer 26*a*, 26*b* (e.g., behind the audio output transducers).

The haptic actuators 40*a*, 40*b* may each be an electromagnetic actuator, piezoelectric actuator, thermal actuator, and/or capacitive actuator, for example. Where the wearable band 28 is in the form of a headband, each circuit substrate 27*a*, 27*b* may be curved (FIG. 3) to conform to a user, for example, user's head.

The wearable electronic device 20 also includes a drive circuit 50. The drive circuit 50 may be carried by both the first and second housings 21*a*, 21*b*. For example, respective portions or segments of the drive circuit are carried by each of the first and second housings 21*a*, 21*b*. In some embodiments, the drive circuit 50 may be carried by either of the first or second housings 21*a*, 21*b*. The drive circuit 50 may be carried by another housing, for example, that is not the first or second housings 21*a*, 21*b*.

Figure 4:
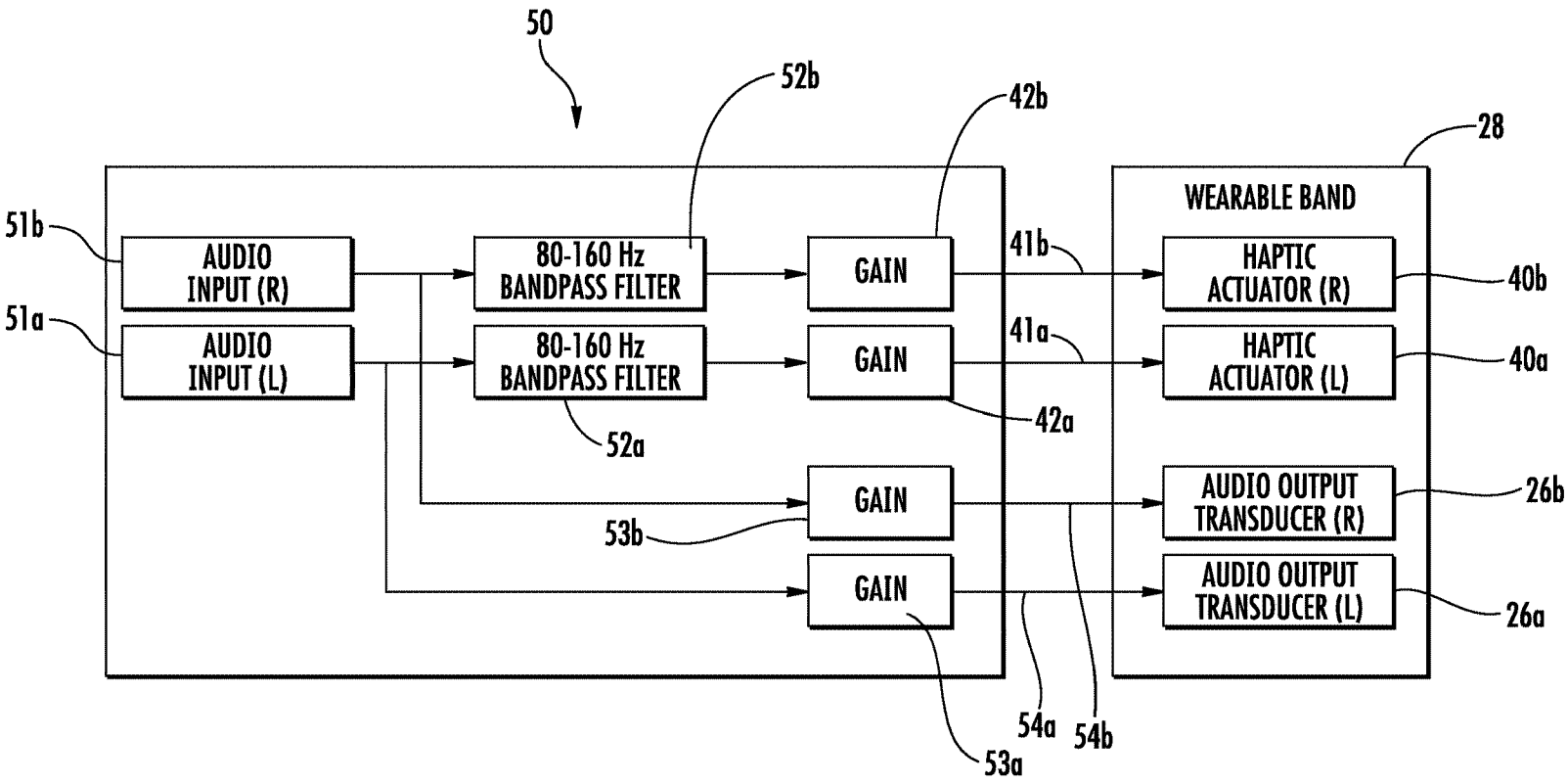
FIG. 4 is a schematic diagram of a drive circuit of the wearable electronic device of FIG. 1.

Referring now additionally to FIG. 4, the drive circuit 50 is configured to concurrently (e.g. at the same time, overlapping in time and/or a subset of time) drive the audio output transducers 26*a*, 26*b* with respective first drive signals and drive the haptic actuators 40*a*, 40*b* with respective second drive signals different than the first drive signals. The first drive signals may be based upon an audio input signal, for example, a left and right channel audio signal. The first and second drive signals may be based upon a same audio input signal, as will be described in further detail below. In some embodiments, the first drive signals may be based upon an audio input signal, for example, audio content, and the second audio signals may be synthesized based upon the audio input signal. The first and second drive signals may be phase delayed.

Further details of an exemplary drive circuit 50 will now be described. The drive circuit 50 includes audio inputs 51*a*, 51*b*, for example, stereo left and right channel audio contents. Haptic actuator outputs 41*a*, 41*b* are coupled to the respective haptic actuators 40*a*, 40*b*. Respective filters 52*a*, 52*b* are coupled between respective ones of the audio inputs 51*a*, 51*b* and haptic actuator outputs 41*a*, 41*b*. The filters 52*a*, 52*b* may each be a bandpass filter, for example, 80-160 Hz bandpass filters. Respective haptic actuator gain stages 42*a*, 42*b* are coupled between respective ones of the audio inputs 51*a*, 51*b* and the haptic actuator outputs 41*a*, 41*b*.

The drive circuit 50 also includes audio outputs 54*a*, 54*b* coupled to respective audio output transducers 26*a*, 26*b*. Respective audio gain stages 53*a*, 53*b* are coupled between respective ones of the audio output transducers 26*a*, 26*b* and the audio outputs 54*a*, 54*b*.

Figure 5:
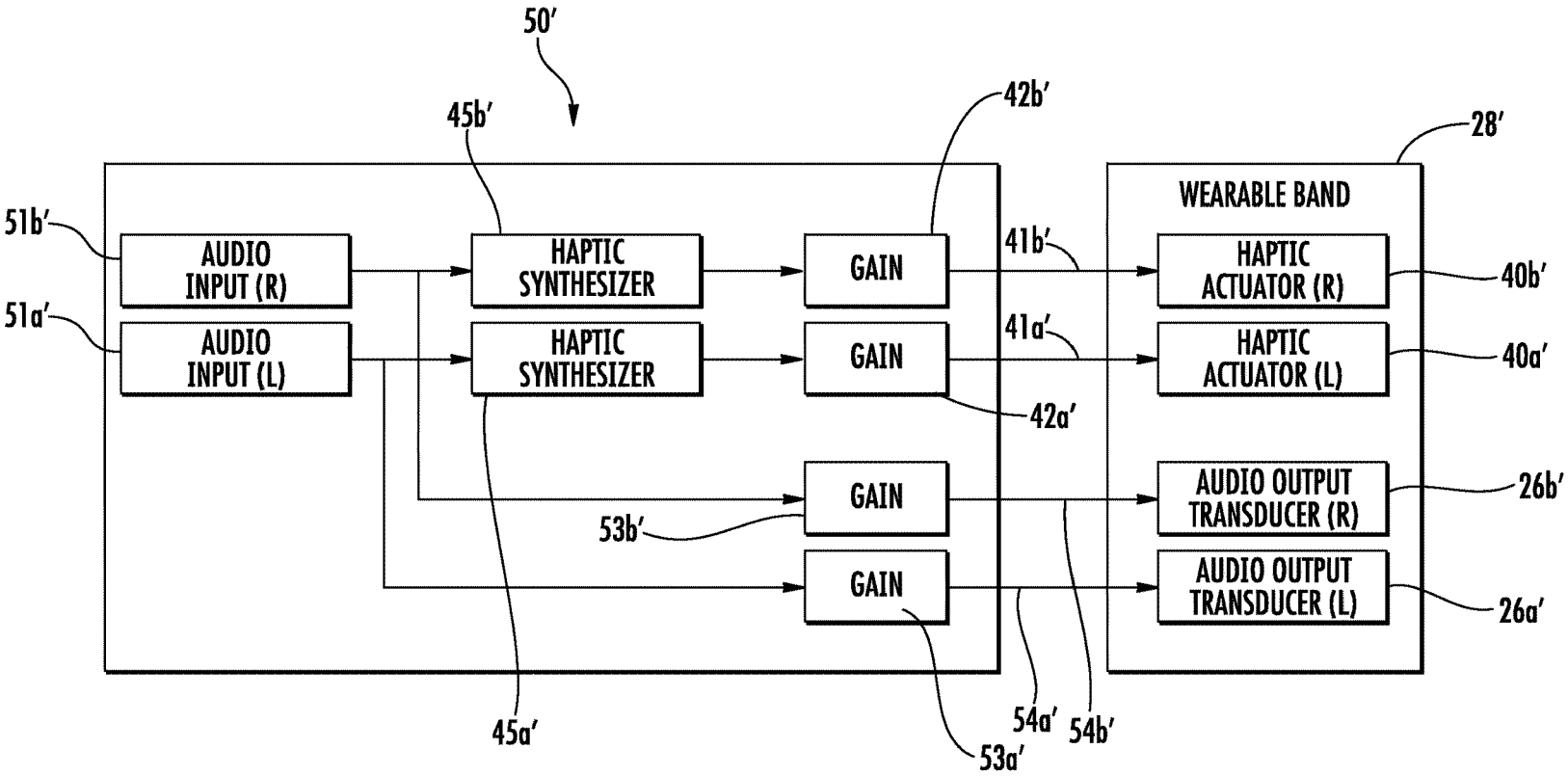
FIG. 5 is a schematic diagram of a drive circuit of a wearable electronic device according to another embodiment.

Referring now to FIG. 5, in another embodiment, first drive signals are based upon an audio input signal, for example, audio content, and the second drive signals are synthesized based upon the audio input signal. More particularly, a respective haptic synthesizer 45*a*', 45*b*' is coupled to the audio inputs 51*a*', 51*b*' and each respective haptic synthesizer is coupled to the haptic actuator outputs 41*a*', 41*b*'. Gain stages 42*a*', 42*b*', 53*a*', 53*b*' may also be coupled between the respective outputs 41*a*', 41*b*', 54*a*', 54*b*' and the respective haptic synthesizers 45*a*', 45*b*' and audio inputs 51*a*', 51*b*'.

Figure 6:
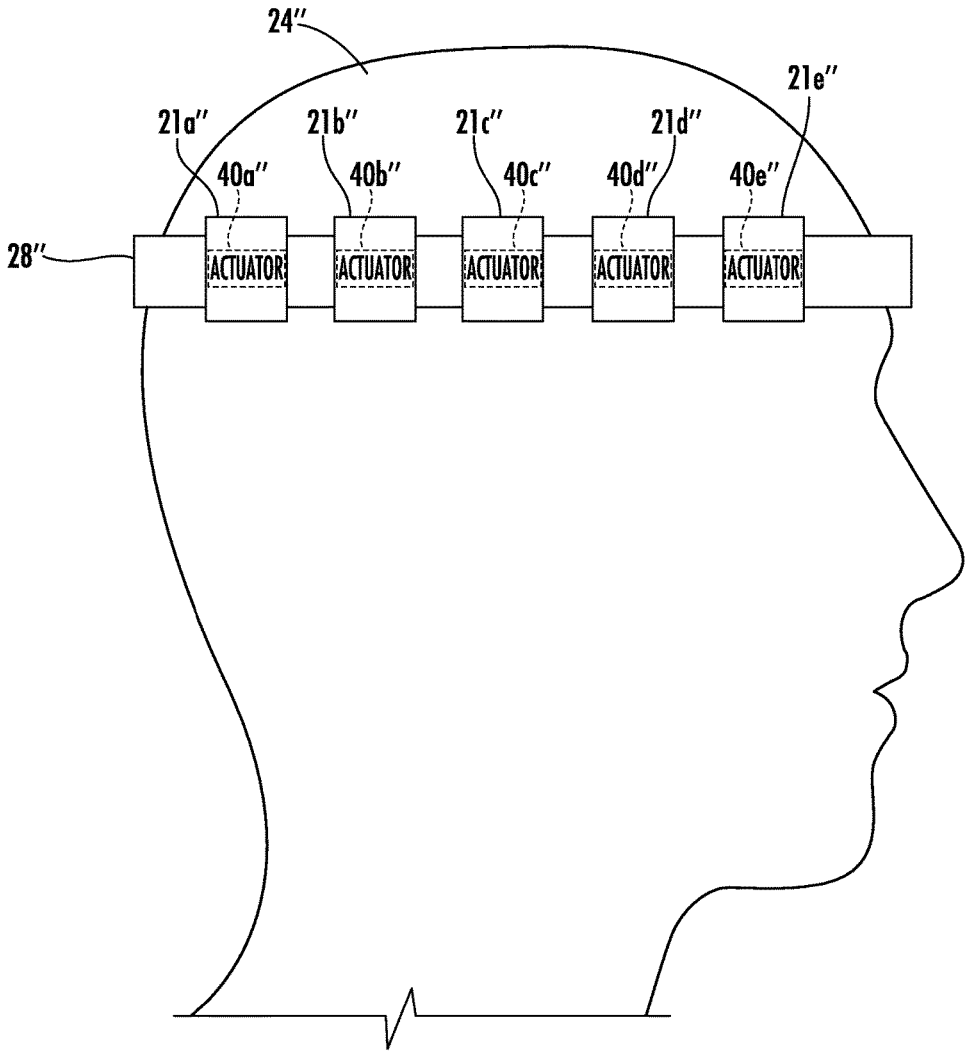
FIG. 6 is a schematic diagram of a wearable electronic device worn by a user according to another embodiment.

Referring now to FIG. 6, in another embodiment multiple haptic actuators 40*a*"-40*e*" may be carried by the wearable band 28" (by way of respective housings 21*a*"-21*e*"), which is illustratively in the form of an extendable headband (i.e., elastic). Respective audio output transducers may optionally be used in the present embodiment, or less than the number of audio output transducers may be used. The driver circuit may drive some of or all of the haptic actuators 40*a*"-40*e*" to generate a desired haptic effect.

Figure 7:
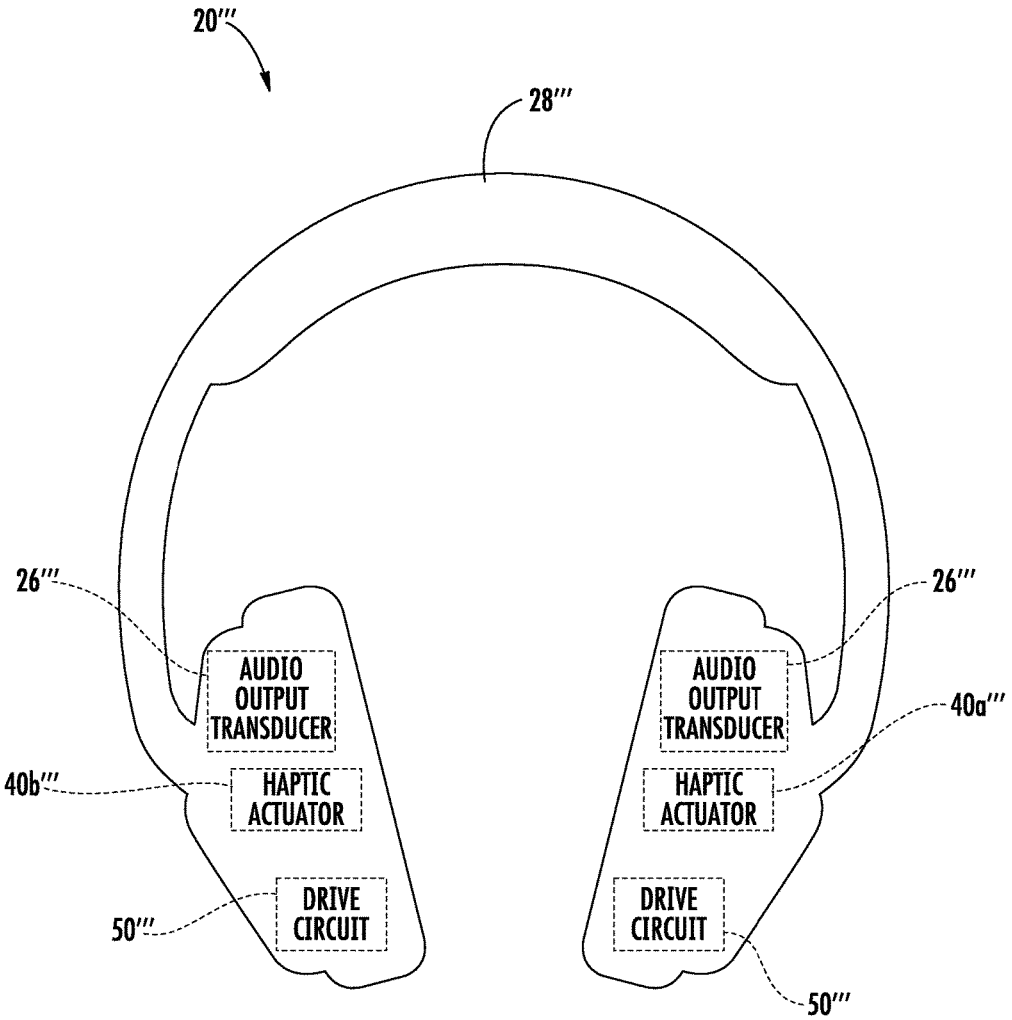
FIG. 7 is a schematic diagram of a wearable electronic device according to another embodiment.

Referring now to FIG. 7, in another embodiment, the wearable device 20''' is illustratively in the form of a headphone, and the wearable band 28''' may include rigid material. Audio output transducer 26*a*''', 26*b*''' and haptic actuator 40*a*''', 40*b*''' pairs are carried by opposing ends of the wearable band 28'''. The drive circuit 50''' may operate or perform operations similar to the embodiments described above.

Figure 8:
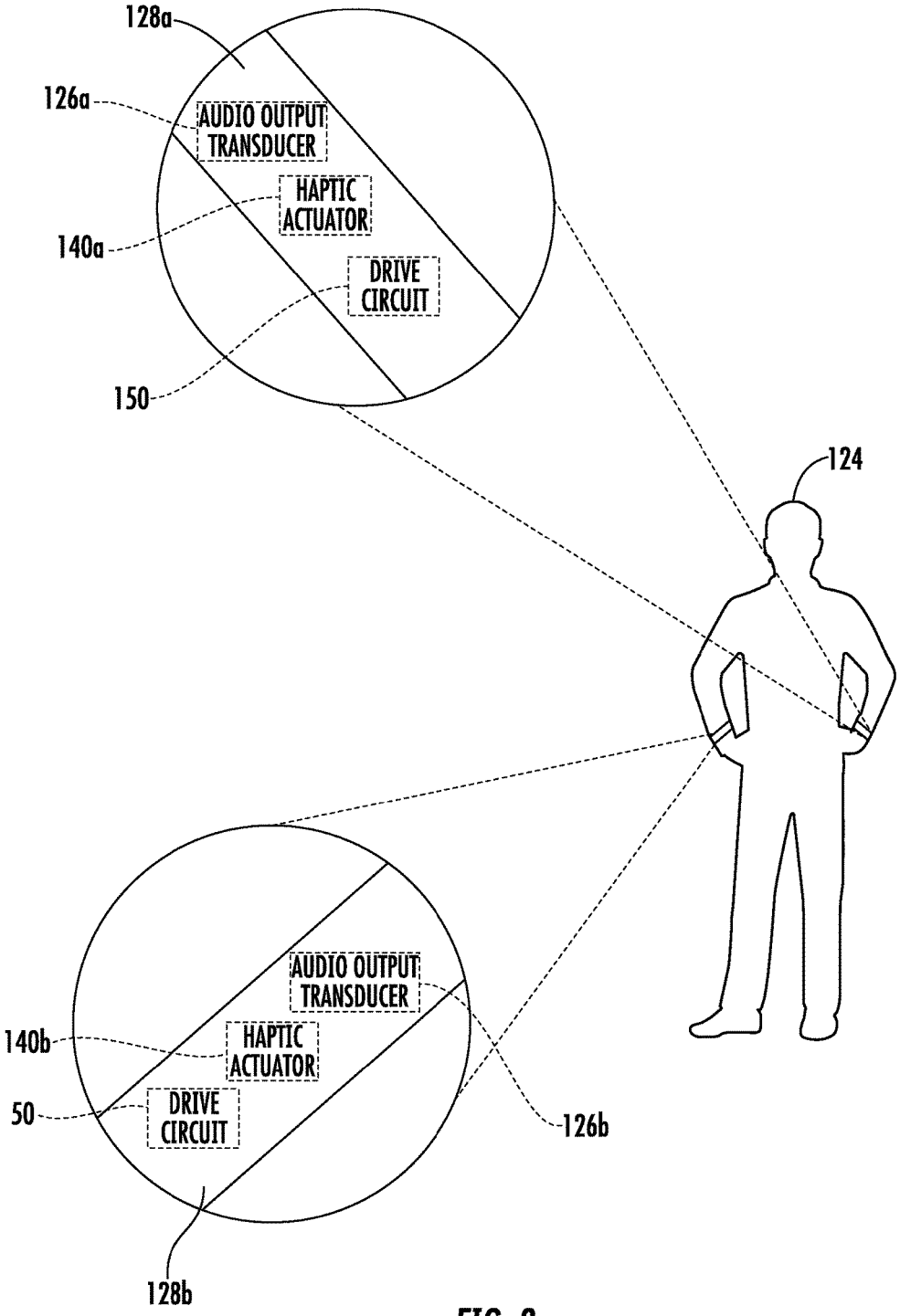
FIG. 8 is a schematic diagram of a wearable electronic device according to another embodiment.

Referring now to FIG. 8, in another embodiment, a first audio output transducer 126*a* and haptic actuator 140*a* pair is carried by a user 124, for example, on a left wrist by way of a first wristband 128*a*, and a second audio output transducer 126*b* and haptic actuator 140*b* pair is carried by the user, for example, on a right wrist by way of a second wristband 128*b*. The drive circuit 150 may operate or perform operations similar to the embodiments described above.

Figure 9:
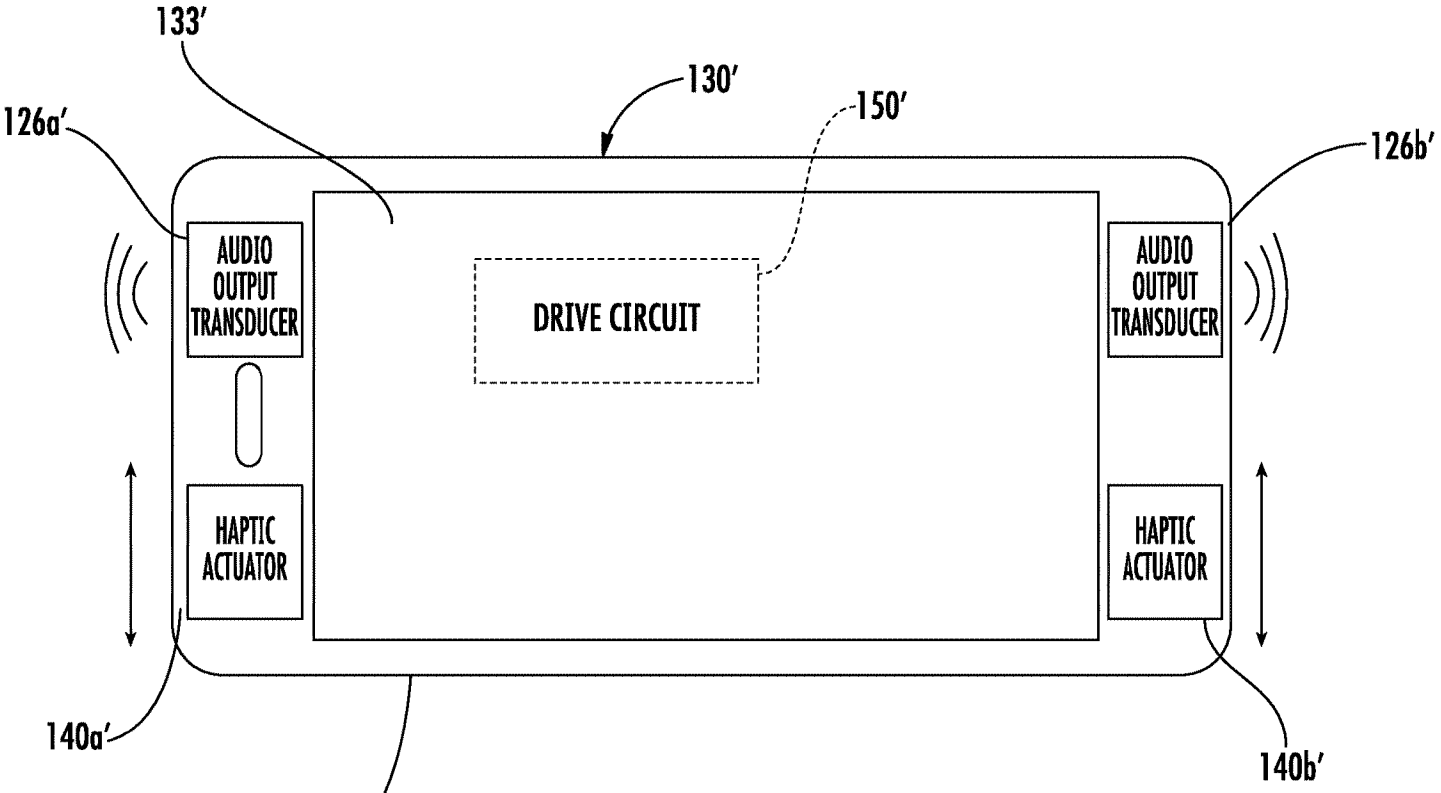
FIG. 9 is a schematic diagram of a portion of a wearable electronic device according to another embodiment.
Figure 10:
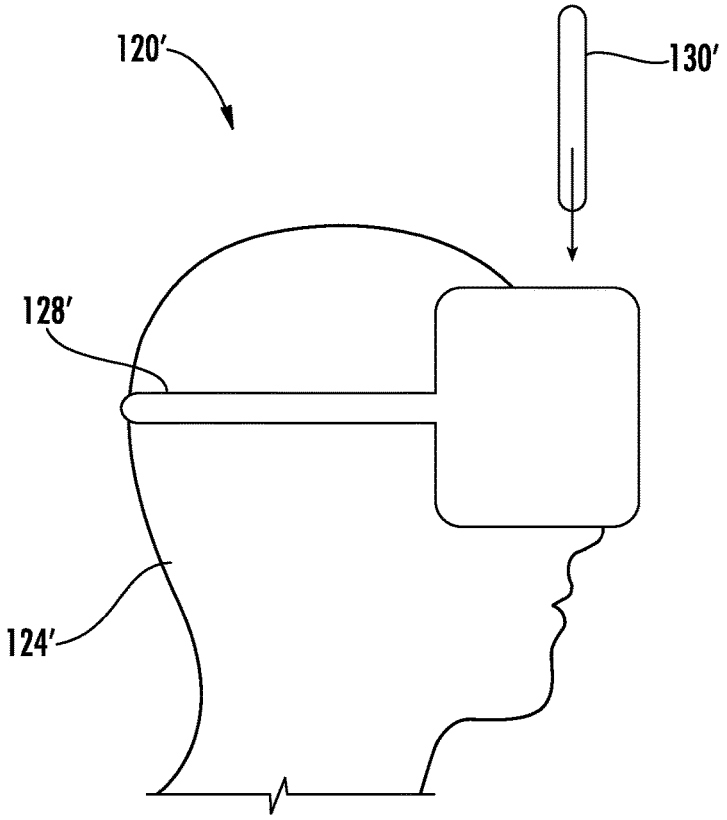
FIG. 10 is a side view of the wearable electronic of FIG. 9.
Figure 11:
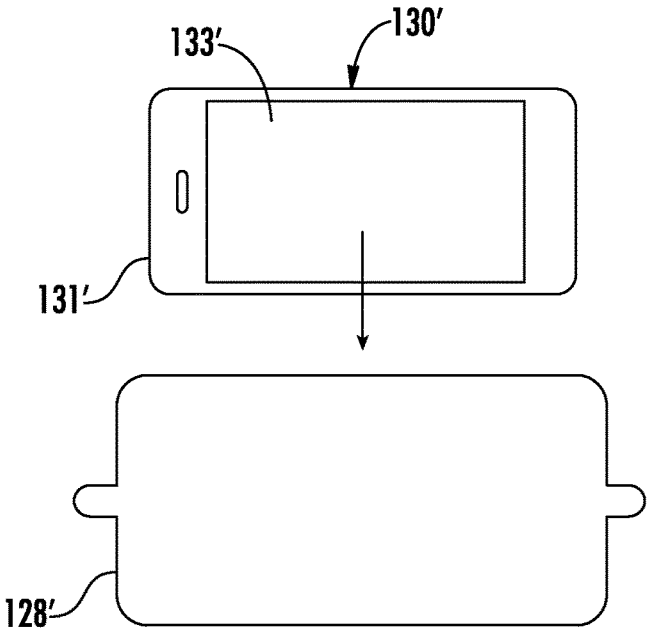
FIG. 11 is a front view of the wearable electronic device FIG. 9.

Referring now to FIGS. 9-11, the wearable device 120' may include a wearable band that is in the form of a smartphone headset 128'. A mobile wireless communications device 130' is carried within the smartphone headset 128'. Respective pairs of audio output transducers 126*a*', 126*b*' and haptic actuators 140*a*', 140*b*' are carried by the device housing 131'. A display 133' is also carried by the device housing 131'. The drive circuit 150' may operate or perform operations similar to the embodiments described above.

As will be appreciated by those skilled in the art, the wearable devices described herein may be particularly advantageous for generating stereo or directional and/or localized haptic feedback. For example, haptic feedback may be time synchronized with sound or visual information (synchronized with the contents played speakers or displays). It will also be appreciated that the wearable device may be implemented using bone conduction, for example.

The wearable devices described herein may provide a more immersive experience by imitating physical phenomena with multiple haptic actuators. For example, a user may play back synchronized waveforms on multiple actuators such that users can feel effects, particularly those involving bass, from a certain direction. A user may also feel a car passing by from right to left.

The wearable devices may also augment the low frequency band of sound with by adding a haptic sensation synchronized to speaker outputs. For example, haptic actuators attached near right and left ears vibrate differently to generate stereo haptic effect, which is synchronized to the speaker outputs. A user may feel improved bass sound due to the added vibration.

Still further, the wearable devices may provide haptic notification with directional information. For example, during navigation, a user may differentiate a "right turn" and "left turn" based on the directionality of haptic notification (e.g., a vibration may start from right side and finish at the left side). A rotational effect may also be generated, for example, based upon phase delayed first and second drive signals.

A method aspect is directed to a method of providing a haptic effect to a user of a wearable electronic device 20. The wearable electronic device includes a wearable band 28, a plurality of audio output transducers 26*a*, 26*b* carried by the wearable band, and a plurality of respective haptic actuators 40*a*, 40*b* carried by the wearable band and adjacent respective ones of the plurality of audio output transducers. The method includes driving the plurality of audio output transducers 26*a*, 26*b* with respective first drive signals, and driving the plurality of haptic actuators 40*a*, 40*b* with respective second drive signals different than the first drive signals.

As will be appreciated by those skilled in the art, any element from any one or more of the embodiments described herein may be used in conjunction with other elements from any of the other embodiments. Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A wearable electronic device comprising:

a wearable band having a closed loop shape;

a plurality of audio output transducers carried by the wearable band;

a plurality of respective haptic actuators carried by the wearable band and adjacent respective ones of the plurality of audio output transducers;

a plurality of curved circuit substrates carried by the wearable band, and wherein each curved circuit substrate carries a respective audio output transducer and haptic actuator pair; and a drive circuit configured to concurrently drive the plurality of audio output transducers with respective first drive signals, and drive the plurality of haptic actuators with respective second drive signals different than the first drive signals.

2. The wearable electronic device of claim 1 wherein the first and second drive signals are based upon a same audio input signal.

3. The wearable electronic device of claim 1 wherein the first drive signals are based upon an audio input signal, and wherein the second drive signals are synthesized based upon the audio input signal.

4. The wearable electronic device of claim 1 wherein the first and second drive signals are phase delayed.

5. The wearable electronic device of claim 1 wherein the wearable band comprises a headband.

6. The wearable electronic device of claim 1 wherein the wearable band comprises a wristband.

7. The wearable electronic device of claim 1 wherein the drive circuit comprises a plurality of audio inputs, a plurality of haptic actuator outputs coupled to respective haptic actuators, and a plurality of respective filters coupled between respective ones of audio inputs and haptic actuator outputs.

8. The wearable electronic device of claim 1 wherein the drive circuit comprises a plurality of audio inputs, a plurality of haptic actuator outputs coupled to respective haptic actuators, and a plurality of respective haptic actuator gain stages coupled between respective ones of audio inputs and haptic actuator outputs.

9. The wearable electronic device of claim 1 wherein the drive circuit comprises a plurality of audio inputs, a plurality of audio outputs coupled to respective audio output transducers, and a plurality of respective audio gain stages coupled between respective ones of audio inputs and audio outputs.

10. A wearable electronic device comprising:

a wearable band having a closed loop shape;

a plurality of audio output transducers carried by the wearable band;

a plurality of respective haptic actuators carried by the wearable band and adjacent respective ones of the plurality of audio output transducers a plurality of curved circuit substrates carried by the wearable band, and wherein each curved circuit substrate carries a respective audio output transducer and haptic actuator pair; and a drive circuit configured to concurrently drive the plurality of audio output transducers with respective first drive signals, and drive the plurality of haptic actuators with respective second drive signals different than the first drive signals, the first and second drive signals being based upon a same audio input signal;

the drive circuit comprising a plurality of audio inputs, a plurality of haptic actuator outputs coupled to respective haptic actuators, and a plurality of respective filters coupled between respective ones of audio inputs and haptic actuator outputs.

11. The wearable electronic device of claim 10 wherein the second drive signals are synthesized based upon the audio input signal.

12. The wearable electronic device of claim 10 wherein the first and second drive signals are phase delayed.

13. The wearable electronic device of claim 10 wherein the wearable band comprises at least one of a headband and a wristband.

14. The wearable electronic device of claim 10 wherein the drive circuit comprises a plurality of respective haptic actuator gain stages coupled between respective ones of audio inputs and haptic actuator outputs.

15. The wearable electronic device of claim 10 wherein the drive circuit comprises a plurality of audio outputs coupled to respective audio output transducers and a plurality of respective audio gain stages coupled between respective ones of audio inputs and audio outputs.

16. A method of providing a haptic effect to a user of a wearable electronic device comprising a wearable band, a plurality of audio output transducers carried by the wearable band having a closed loop shape, a plurality of respective haptic actuators carried by the wearable band and adjacent respective ones of the plurality of audio output transducers, and a plurality of curved circuit substrates carried by the wearable band and each carrying a respective audio output transducer and haptic actuator pair, the method comprising:

concurrently driving the plurality of audio output transducers with respective first drive signals, and driving the plurality of haptic actuators with respective second drive signals different than the first drive signals.

17. The method of claim 16 wherein the first and second drive signals are based upon a same audio input signal.

18. The method of claim 16 wherein the first drive signals are based upon an audio input signal, and wherein the second drive signals are synthesized based upon the audio input signal.

19. The method of claim 16 wherein the first and second drive signals are phase delayed.

* * * * *